US007484324B2

(12) United States Patent
Lee

(10) Patent No.: US 7,484,324 B2
(45) Date of Patent: Feb. 3, 2009

(54) ROTARY SIGN BOARD

(76) Inventor: Gye-Soo Lee, #105-501, Gwangmyung Apt. 336-1, Simgok-dong, Incheon, Seo-Gu (KR)

( * ) Notice: Subject to any disclaimer, the term of this patent is extended or adjusted under 35 U.S.C. 154(b) by 367 days.

(21) Appl. No.: 11/198,276

(22) Filed: Aug. 8, 2005

(65) Prior Publication Data

US 2007/0113438 A1 May 24, 2007

(51) Int. Cl.
*G09F 11/23* (2006.01)
*G09F 7/22* (2006.01)

(52) U.S. Cl. ..... 40/472; 40/473; 40/493

(58) Field of Classification Search ..... 40/493, 40/494, 502, 506, 472, 473
See application file for complete search history.

(56) References Cited

U.S. PATENT DOCUMENTS

| | | | | | |
|---|---|---|---|---|---|
| 979,605 | A | * | 12/1910 | Turnpaugh | 40/473 |
| 1,045,642 | A | * | 11/1912 | Torrey | 40/472 |
| 1,637,988 | A | * | 8/1927 | Egan | 40/473 |
| 3,960,352 | A | * | 6/1976 | Plattner et al. | 248/309.1 |
| 4,015,349 | A | | 4/1977 | Dunne | |
| 4,021,946 | A | | 5/1977 | Bradshaw | |
| 4,164,084 | A | * | 8/1979 | Crockett | 40/660 |
| 4,169,327 | A | | 10/1979 | Stilling | |
| 5,054,219 | A | * | 10/1991 | Hoyt et al. | 40/473 |
| 5,255,465 | A | | 10/1993 | Perez | |
| 5,315,776 | A | | 5/1994 | Strawbridge et al. | |
| 5,409,191 | A | | 4/1995 | Wenmaekers | |
| 5,806,221 | A | | 9/1998 | Vander Woude | |
| 6,216,371 | B1 | | 4/2001 | Kim | |
| 6,250,000 | B1 | * | 6/2001 | Diaz | 40/473 |
| 6,345,458 | B1 | * | 2/2002 | Garibian | 40/506 |

FOREIGN PATENT DOCUMENTS

| | | |
|---|---|---|
| JP | 07-020805 | 1/1995 |
| JP | 09-044108 | 2/1997 |
| JP | 2000-206915 | 7/2000 |
| JP | 2005-134530 | 5/2005 |
| KR | 20-0223555 | 2/2001 |
| KR | 20-0289253 | 9/2002 |
| KR | 1020030010457 | 2/2003 |

* cited by examiner

*Primary Examiner*—Cassandra Davis
(74) *Attorney, Agent, or Firm*—Robert E. Bushnell, Esq.

(57) ABSTRACT

A rotary sign board is installed around the outer periphery of a post in an existing building in such a manner as to be rotated at a predetermined speed, thereby enhancing the advertisement effect. The rotary sign board includes a support portion for surrounding the outer periphery of the lower portion of a cylindrical post; a cover frame for surrounding the outer periphery of the post and having a transparent window formed along the outer peripheral surface thereof; a rotary body disposed in parallel relation with respect to the outer periphery of the post at the inside of the transparent window of the cover frame; a driving portion fixed to abut against the one top side of the cover frame for providing a rotary force to the rotary body; a rotary body support portion provided at the inside of the cover frame; a rotary portion for rotating the rails of the rotary body; and a support rod fixedly mounted to each side of the support portion.

11 Claims, 5 Drawing Sheets

ROTARY SIGN BOARD

BACKGROUND OF THE INVENTION

1. Field of the Invention

The present invention relates to a rotary sign board, and more particularly, to a rotary sign board that is installed around the outer periphery of a post in a building or on an underground passage and is rotated at a predetermined speed, thereby effectively providing a variety of information to people who pass there.

2. Background of the Related Art

Generally, sign boards are used to provide all kinds of commercial or noncommercial information to lots of unspecified people who pass around them, and thus, all kinds and sizes of sign boards are installed everywhere people come and go. There are provided a great variety of sign boards including a painting board having a flat member on which a given piece of information is displayed by using pigments and a big-sized electric sign board providing moving images by using light emitting diodes. This invention is applicable to all kinds of sign boards introduced up to now, providing a display portion having various visual transmitting media on which given information is indicated disposed around the post of a building, the display portion rotated at a given speed by a driving portion like a motor.

FIG. 1 is a partly cut perspective view showing a conventional lamp-embedded sign board. As shown, the conventional sign board includes an outer frame 110 forming a given space portion at the inside thereof, a plurality of fluorescent lamps 130 mounted at the inside of the outer frame 110 to provide given intensity of light, a reflection board 140 disposed at the rear of the plurality of fluorescent lamps 130 for reflecting the light generated from the fluorescent lamps 130, and a display panel 120 mounted at the front of the outer frame 110 and formed of a semitransparent material for transmitting the light generated from the fluorescent lamps 130. In this case, the visual information to be provided is printed on the one face of the display panel 120.

Such the type of sign board is generally installed on the wall surface of a building or structure to provide given pieces of visual information to people who come and go there, and if necessary, the fluorescent lamps 130 work to attract the interest of the people to there.

However, the conventional sign board is of a generally flat structure that is fixed to a prescribed position, which makes the visible area limited to a front direction, and further, the printed information is fixed on the display panel 120, without any movement, which makes the information very simple thus to fail to attract the interest of people to the sign board.

SUMMARY OF THE INVENTION

Accordingly, the present invention has been made in view of the above-mentioned problems occurring in the prior art, and it is an object of the present invention to provide a rotary sign board that is installed around the outer periphery of a post in a building or on an underground passage and is rotated at a predetermined speed, thereby providing a variety of information at the same time to people who pass there in every direction and attracting their eyes to improve the effect of advertisement.

It is another object of the present invention to provide a rotary sign board that is installed for a given period of time on the post of an existing building or structure in an easy manner and is removed completely, without leaving any marks on the outer surface of the post.

It is yet another object of the present invention to provide a rotary sign board that provides a stable structure and performance and makes a rotary body light thus to minimize the consumption of a driving energy, as a quantity of consumption of driving energy depends upon the mass of the rotary body.

To accomplish the above objects, according to the present invention, there is provided a rotary sign board including: a support portion for surrounding a outer periphery of a lower portion of a cylindrical post in a round band shape, forming a rack having a given width along an upper outer periphery thereof, and fixedly mounted to the cylindrical post for supporting given load applied over the rack; a cover frame for surrounding the outer periphery of the post in predetermined thickness and width, fixed supportably to the rack of the support portion, and having a transparent window formed along the outer periphery thereof; a rotary body disposed in parallel relation respect to the outer periphery of the post and disposed between the cylindrical post and the transparent window of the cover frame, the rotary body having a cylindrical display panel displaying advertising information and a ring-shaped rail fixedly coupled to each of a top and bottom outer peripheral portions of the display panel through an insertion groove for receiving each of the top and bottom outer peripheral portions of the display panel; a driving portion fixed to abut against a top side of the cover frame and for providing a rotary force to the rotary body; a rotary body support portion provided between the cylindrical post and the cover frame, secured to the cover frame at one end thereof, and rotatably supporting the rotary body; a rotary portion for rotating the rails of the rotary body by the rotary force applied from the driving portion; and a support rod fixedly mounted to each side of the support portion in such a manner as to abut with the ground at the one end thereof.

The support portion has a plurality of circular support members in such a manner that a side end of each support member is coupled to a side end of an adjacent support member, thereby forming the round band shape, and with the coupling force thereof, it is secured to the outer periphery of the post. At this time, the total length of the inner peripheries of the plurality of support members is somewhat shorter than the length of the outer periphery of the post, and the coupling of the side ends of the support members is made by coupling means like a bolt and a nut, thus enhancing the support force of the support portion.

The support portion further has a plurality of screw holes formed on a face abutting with the outer periphery of the post and a fixing bolt fastened to each of the plurality of screw holes. At this time, the plurality of screw holes and the fixing bolts are desirably formed at the connected portion between tiles or metal surface materials of the outer surface of the post, such that no marks are formed on the outer surface of the post. If there is no connected portion on the outer surface of the post, a reinforcing member is inserted between the front end of the fixing bolt and the outer surface of the post, with a result that the pressure at the front end of the fixing bolt is distributed to the overall reinforcing member.

The cover frame has a cylindrical metal panel disposed along the inner and outer peripheries thereof to support an internal structure thereof, transmits the load of the rotary body to the support portion through the rotary body support portion, and has the transparent window formed of a transparent resin film or a cylindrical resin panel disposed along the outer periphery thereof, such that the advertising information on the display panel disposed at the inside of the transparent window is read at the outside.

The display panel is preferably formed of a generally cylindrical resin panel having given rigidity such that the shape is not deformed even during rotation of the rails fixed to the top and bottom outer peripheral ends thereof.

The cylindrical resin panel is selected from a variety of resins like polycarbonate (PC), polyester (PET), polyethylene (PE), and acryl.

The display panel having the given rigidity is provided to the rails fixed to the top and bottom outer peripheral ends thereof, for constituting the rotary body of this invention, which enables the rotary body to be simplified and light thus to minimize the energy consumed for the rotation of the advertising information.

To increase the visual effect of the sign board, preferably, light emitting means is disposed at the inside of the rotary body for emitting the light to the outside through the display panel, and at this time, the display panel is preferably formed of a semitransparent cylindrical resin panel such that the light generated from the light emitting means is emitted to the outside.

The driving portion includes a driving motor fixed at the top or bottom side of the cover frame and a decelerator connected at an input shaft to a rotary shaft of the driving motor and at an output shaft to the rotary portion for increasing and decreasing the rotary force thereof.

The rotary portion, which is connected to the output shaft of the decelerator, rotates the rotary body with the rotary force applied from the driving portion, and includes a friction wheel for rotating the rail of the rotary body by the friction force thereof and a pressurizing assembly for pressurizing the rotary body against the friction wheel, thus to provide a given friction force between the rail and the friction wheel.

The rotary body support portion is disposed in a radial direction with respect to the post at the inside of the cover frame and includes a plurality of support shafts each secured to an inner peripheral surface of the cover frame at the one end thereof and a support roller rotatably disposed at the other end of each support shaft for supporting the rails of the rotary body.

In other words, the rotary body is supported by the support rollers rotatably contacted with the lower portions of the rails and rotated by the friction force with the friction wheel rotatably contacted with the sides of the rails.

In this case, the rotary portion may be comprised of a toothed wheel connected to the output shaft of the driving portion and a rail forming a toothed surface along the inner peripheral surface thereof, the toothed surface operating in engaged relation with the toothed wheel, and the rotary body support portion may be comprised of a rail guide forming a groove into which the rail is mounted and a rail forming a roller at the bottom surface such that the roller is rotated into the groove of the rail guide.

The support rod further includes a length adjustor screwed with the lower end thereof for adjusting the length thereof such that even though the ground at the time of installing the rotary sign board of this invention is not flat, with the adjustment of the length adjustor, the support portion is horizontally installed on the ground.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Reference will now be made in detail to the preferred embodiments of the present invention, examples of which are illustrated in the accompanying drawings.

Figure 1:
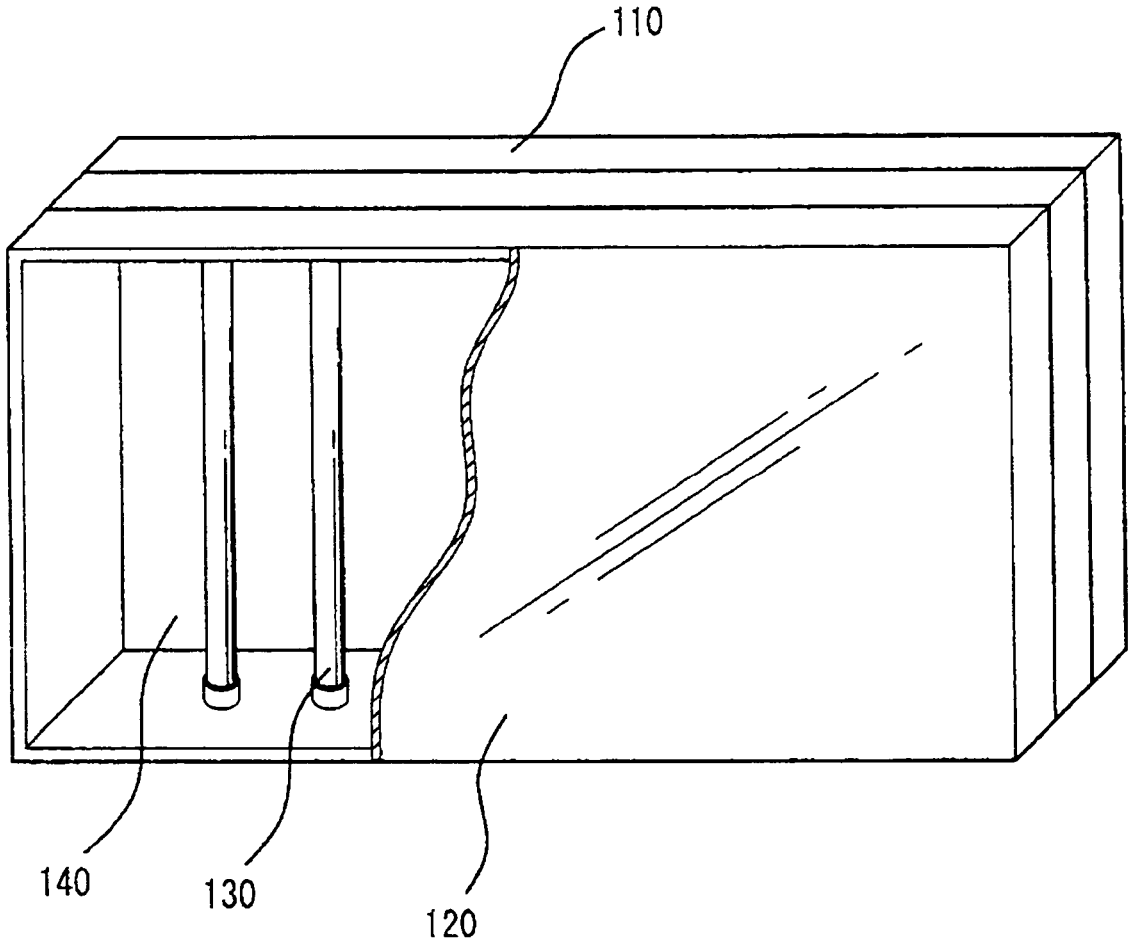
FIG. 1 is a partly cut perspective view showing a conventional lamp-embedded sign board.
Figure 2:
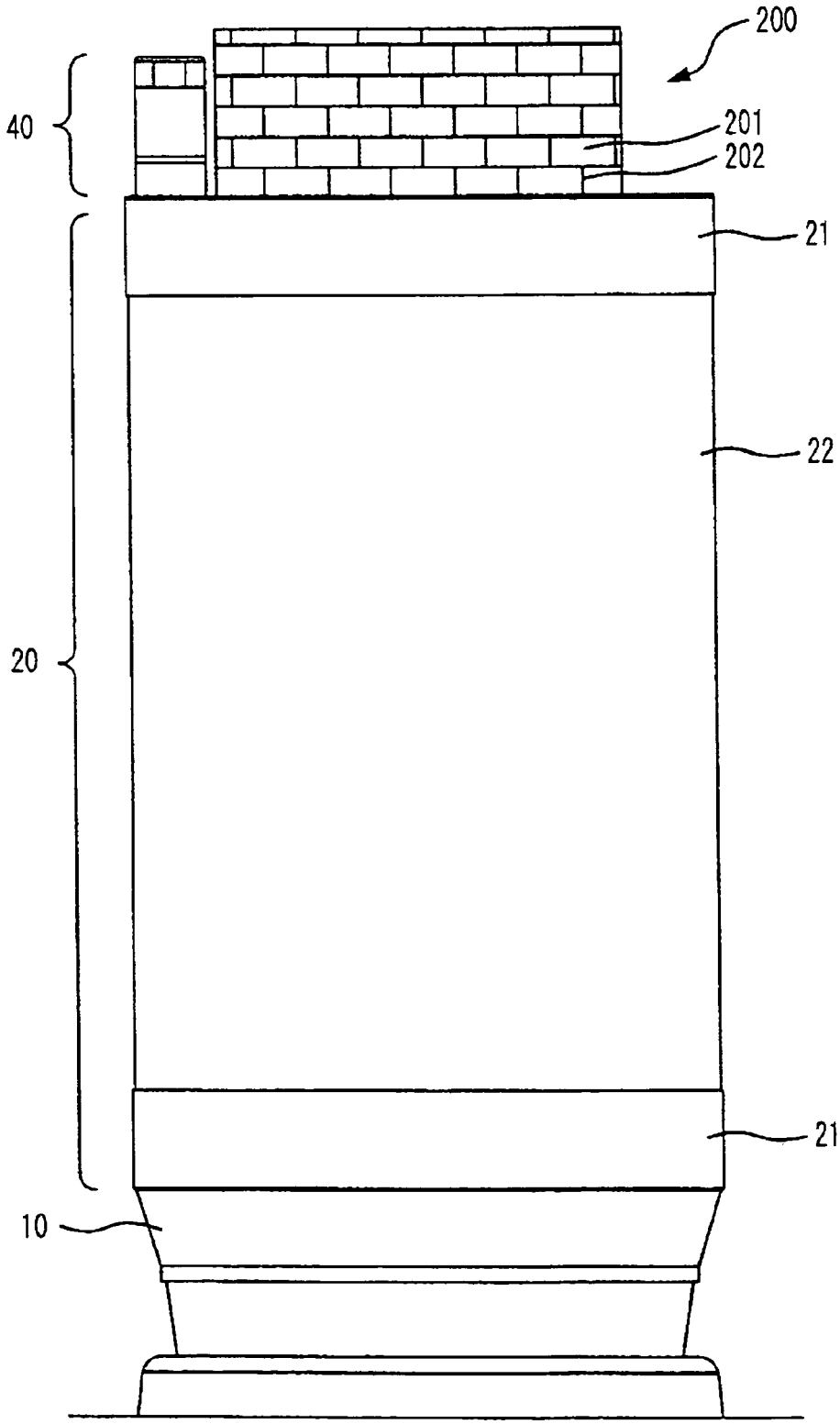
FIG. 2 is a front view showing a rotary sign board according to the present invention which is installed around a post.

FIG. 2 is a front view showing a rotary sign board according to the present invention which is installed around a post. The rotary sign board is installed around the outer periphery of a cylindrical post 200 of an existing structure. The rotary sign board of this invention includes a support portion 10 that surrounds the outer periphery of the lower portion of the cylindrical post 200 in a round band shape and is fixedly mounted to the cylindrical post 200 to support given load applied over there, a cover frame 20 that surrounds the post 200 in predetermined thickness and width, having a cylindrical strong metal panel 21 disposed along the inner and outer peripheries thereof and a transparent window 22 formed of a transparent resin panel disposed along the outer periphery thereof, and a driving portion 40 that is fixed to abut against the top side of the cover frame 20.

A display panel 31 on which advertising information is displaced is spaced apart from the inside of the transparent window 22, and a rotary body 30 including the display panel 31 is rotated by the rotary force applied by the driving portion 40, such that as the display panel 31 is rotated, the attention of people is paid thereto, which enables the people coming and going in every direction to read the advertising information.

Figure 3:
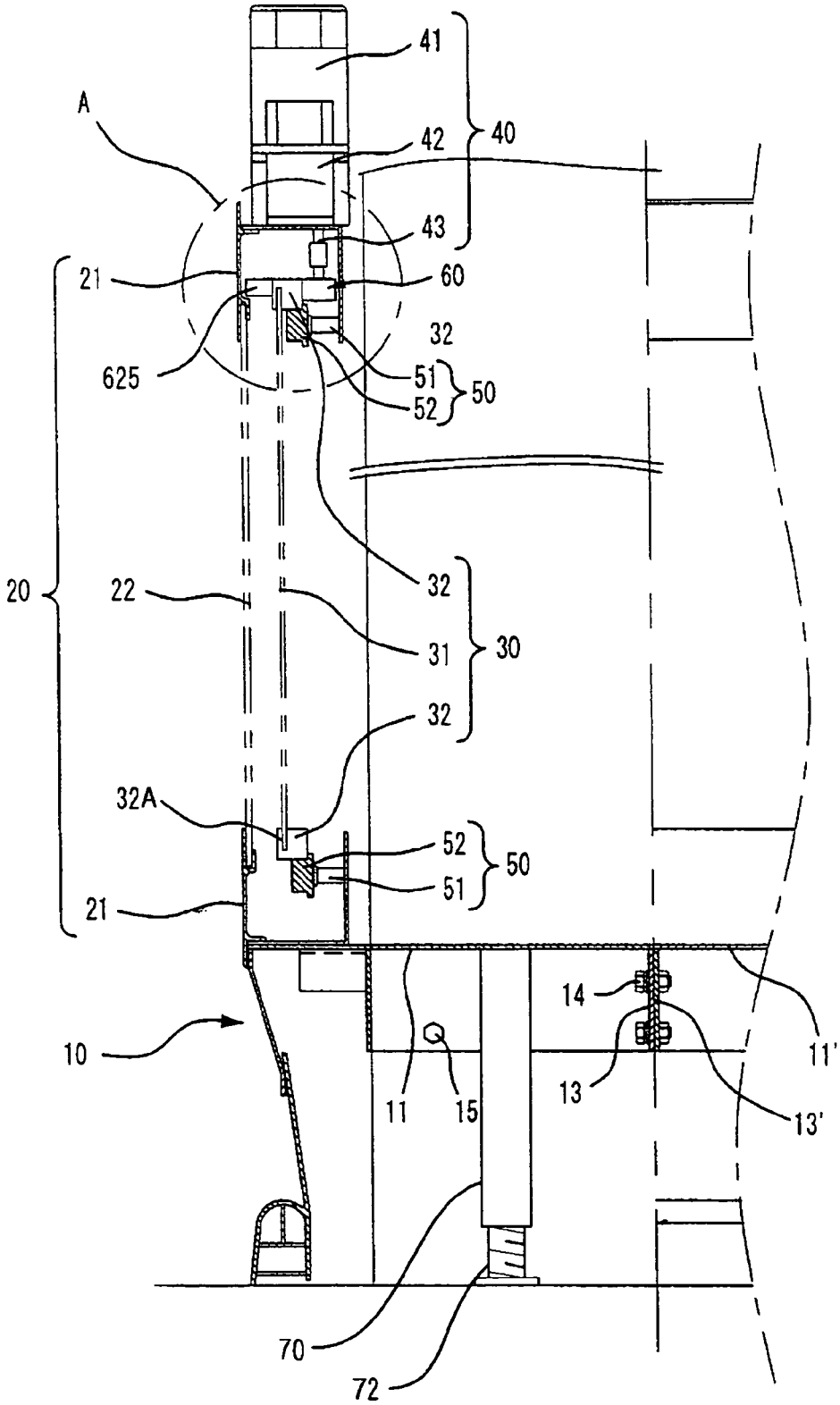
FIG. 3 is a sectional view showing the rotary sign board of this invention.

FIG. 3 is a sectional view showing the rotary sign board of this invention. The support portion 10 has a plurality of circular support members 11 and 11' in such a manner that the side end 13 of the support member 11 is coupled to the side end 13' of the adjacent support member 11', thereby forming the round band shape. The coupling of the side ends 13 and 13' of the support members 11 and 11' is made by means of coupling means 14 like a bolt and a nut.

The support portion 10 has a plurality of screw holes formed on the face abutting with the outer periphery of the post 200, and a fixing bolt 15 is fastened to each of the plurality of screw holes. At this time, the plurality of screw holes are desirably formed between tiles 201 and the tiles 202 of the post 200.

The support portion 10 forms a rack protruded by a predetermined thickness from the outer periphery of the post 200, such that the cover frame 20 is mounted on the rack of the support portion 10. The cover frame 20 has the cylindrical metal panel 21 disposed along the inner and outer peripheries thereof, the cylindrical metal panel 21 adapted to support a rotary body support portion 50 at the inside thereof. Further, the cover frame 20 has the transparent window 22 formed of a transparent resin film or a cylindrical resin panel disposed along the outer periphery thereof, such that the advertising information on the display panel 31 disposed at the inside of the transparent window 22 is read at the outside.

A ring-shaped rail 32 is fixed along each of the top and bottom end outer peripheries of the display panel 31 thus to form the rotary body 30 that is rotatably supported around the post 200 by means of the rotary body support portion 50 disposed at the bottom side of each of the rails 32. Each of the rails 32 forms an insertion groove 32A into which the top or bottom outer peripheral end of the display panel 31 is inserted, which permits the display panel 31 to be easily mounted by an installer.

The display panel 31 is preferably formed of a generally cylindrical resin panel such that the support force applied from the rotary body support portion 50 is sent evenly to the whole body thereof and as it has given rigidity, the shape is not deformed even during rotation. Moreover, the display panel 31 is preferably transparent such that the light generated from light emitting means disposed at the inside thereof is emitted to the outside, together with the advertising information on the display panel 31. For example, the display panel 31 is formed of polycarbonate (PC) or acrylic resin having good rigidity and optical properties.

The driving portion 40 includes a driving motor 41 that is fixed at the top side of the cover frame 20 and a decelerator 42 that is connected at an input shaft to the rotary shaft of the driving motor 41 and at an output shaft 43 to the rotary portion 60 in which a rotary roller 61 is contained, for increasing and decreasing the rotary force thereof. Alternatively, the driving motor 41 can be fixed at a bottom side of the cover frame.

Figure 4:
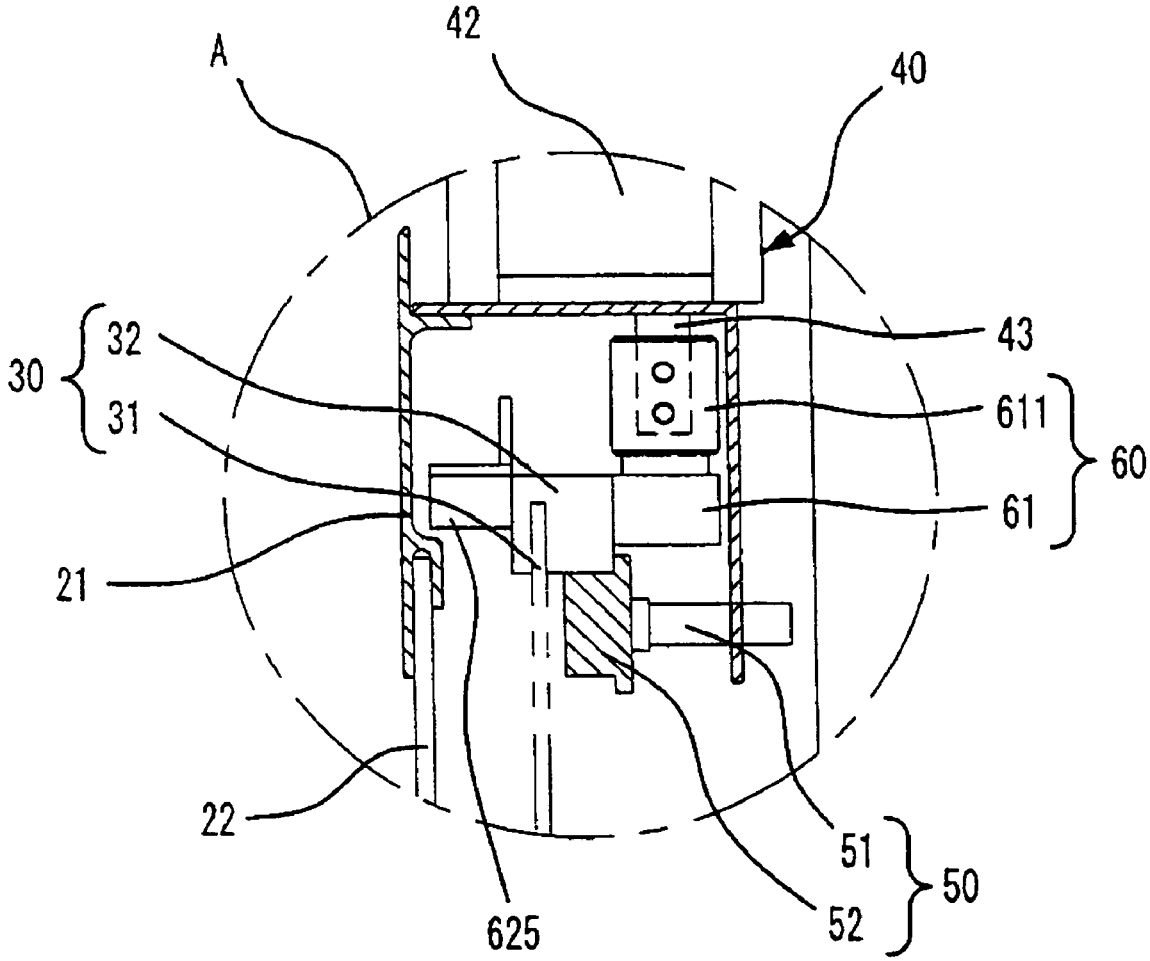
FIG. 4 is a sectional view showing the details of a portion 'A' of FIG. 3.

FIG. 4 is a sectional view showing the details of a portion 'A' of FIG. 3. As shown, the rotary body support portion 50 is disposed in a radial direction with respect to the post 200, provided with a plurality of support shafts 51 each having one end fixed to the inner periphery of the cover frame 20 and a support roller 52 rotatably coupled to each of the support shafts 51. The support rollers 52 make the rail 32 of the rotary body 30 rotated in a peripheral direction with respect to the post 200.

The rotary portion 60 that rotates the rotary body 30 with the rotary force applied from the driving portion 40 is connected through a coupling 611 to the output shaft 43 of the decelerator 42, having a friction wheel 61 adapted to rotate the rail 32 of the rotary body 30 in the peripheral direction with respect to the post 200.

The rotary portion 60 further includes a pressurizing assembly 620 that pressurizes the rotary body 30 against the friction wheel 61, thus to provide a given friction force between the rail 32 and the friction wheel 61.

Figure 5:
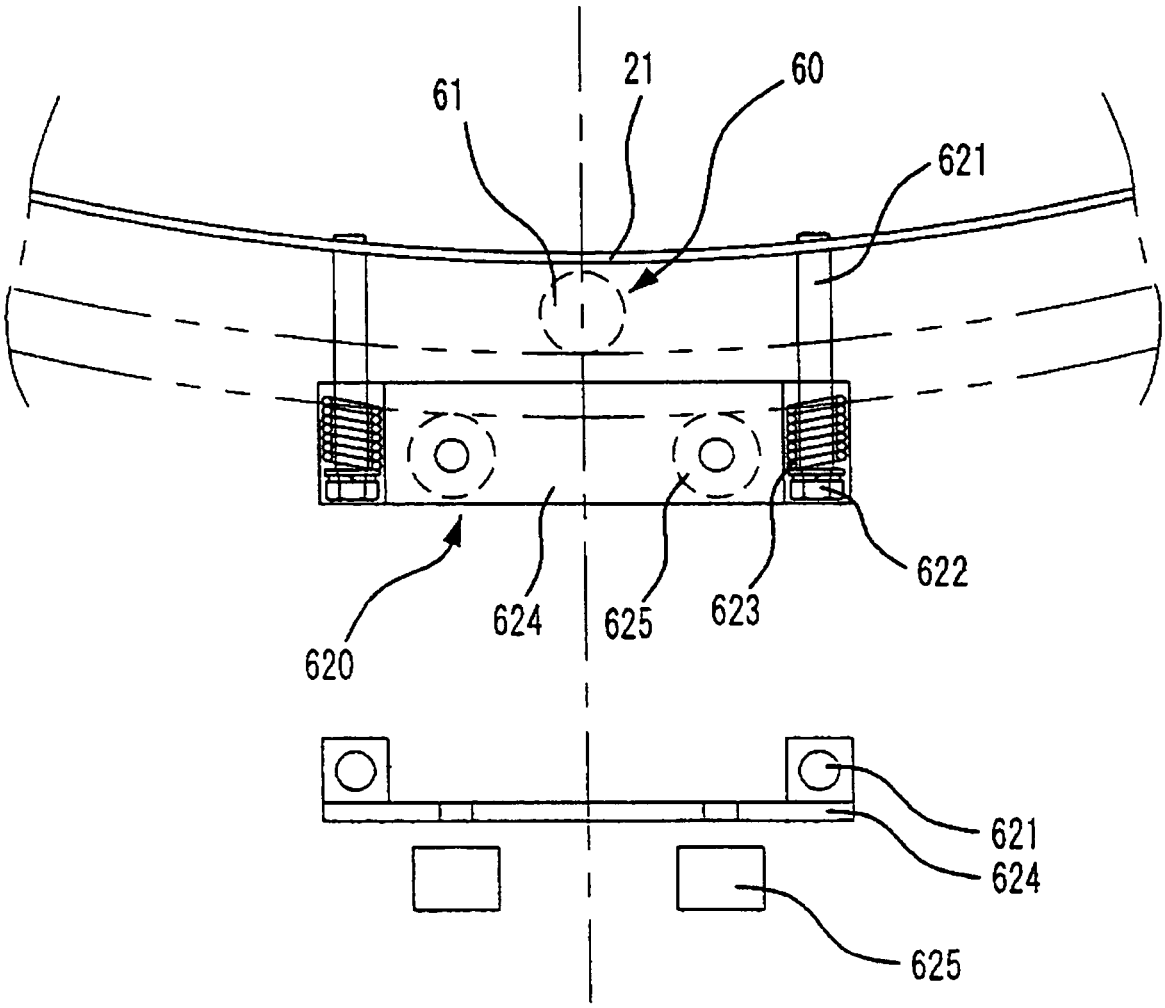
FIG. 5 is a front and top view showing the pressurizing assembly of the rotary sign board of this invention.

FIG. 5 is a front and top view showing the pressurizing assembly of the rotary sign board of this invention. The pressurizing assembly 620 is disposed in a radial direction with respect to the post 200 at the inside of the cover frame 20, each provided with a spring guide bar 621 secured to the inner periphery of the cover frame 20 at the one end thereof and forming a spring support end at the other end thereof, a spring 623 guided by the spring guide bar 621 and supported at the one ends thereof by the spring support end 622, a pressurizing roller frame 624 pressurized against the friction wheel 61 by the other end of the spring 623, and a pressurizing roller 625 rotatably coupled with the pressurizing roller frame 624 around the shaft parallel to the shaft of the friction wheel 61 and contacted with the rail 32 of the rotary body 60 to pressurize the rail 32.

On the other hand, a support rod 70 is fixedly mounted to each side of the support portion 10 and includes a length adjustor 72 that is disposed on the ground to support the load applied to the support portion 10. The length adjustor 72 is screwed with the lower end of the support rod 70 such that even though the ground on which the support portion 10 is installed is not flat, it can horizontally support the support portion 10 with ease.

As described in the foregoing, there is provided a rotary sign board according to the present invention in which the display panel on which advertising information is displayed is rotated around the outer periphery of a post, thereby providing the advertising information at the same time to people who pass there in every direction and attracting their eyes to improve the effect of advertisement.

In addition, the rotary sign board of this invention is installed for a given period of time on the post of an existing building or structure in an easy manner and is removed completely, without leaving any marks on the tiles or metal surface materials of the post.

Moreover, the rotary sign board of this invention has the rotary body formed of the rails secured to the top and bottom ends of the display panel, which provides a stable structure and performance and makes the rotary body light thus to minimize the consumption of a driving energy.

While the present invention has been described with reference to the particular illustrative embodiments, it is not to be restricted by the embodiments but only by the appended claims, and therefore, it is to be understood that other modifications and variations may be made without departing from the substance and scope of the present invention, as those skilled in the art will readily understand. Such alternate modifications and variations are within the scope of the present invention which is intended to be limited only by the appended claims and equivalents thereof.

What is claimed is:

1. A rotary sign board comprising:

a support portion for surrounding an outer periphery of a lower portion of a cylindrical post in a round band shape in such a manner as to be fixedly mounted to the outer periphery of the cylindrical post and for forming a rack along an outer periphery of the cylindrical post for supporting given load applied over the rack;

a cover frame for surrounding the outer periphery of the post in predetermined thickness and width, fixed supportably to the rack of the support portion, and having a transparent window formed along the outer peripheral surface thereof;

a rotary body disposed in parallel with respect to the outer periphery of the post and disposed between the cylindrical post and the transparent window of the cover frame, the rotary body provided with a cylindrical display panel displaying advertising information and with a rail fixedly coupled to each of a top and a bottom outer peripheral portions of the display panel through an insertion groove for receiving each of the top and bottom outer peripheral portions of the display panel;

a driving portion fixed to abut against a top side of the cover frame and for providing a rotary force to the rotary body;

a rotary body support portion provided between the cylindrical post and the cover frame, secured to the cover frame at one end thereof, and rotatably supporting the rotary body;

a rotary portion for rotating the rails of the rotary body by the rotary force applied from the driving portion; and a support rod fixedly mounted to each side of the support portion in such a manner as to abut with the ground at the one end thereof.

2. The rotary sign board as defined in claim 1, wherein the support portion has a plurality of circular support members in such a manner that a side end of each support member is coupled to a side end of an adjacent support member, thereby forming the round band shape, and with the coupling force thereof, the support portion is secured to the outer periphery of the post.

3. The rotary sign board as defined in claim 1, wherein the support portion further has a plurality of screw holes formed on a face abutting with the outer periphery of the post and a fixing bolt fastened to each of the plurality of screw holes.

4. The rotary sign board as defined in claim 1, wherein the cover frame has a cylindrical metal panel disposed along the inner and outer peripheries thereof to support an internal structure thereof, and the transparent window is formed of a transparent resin film or a cylindrical resin panel disposed along the outer periphery thereof.

5. The rotary sign board as defined in claim 1, wherein the display panel is formed of a generally cylindrical resin panel having given rigidity such that the shape is not deformed even during rotation of the rails.

6. The rotary sign board as defined in claim 1, wherein the rotary body support portion is disposed in a radial direction with respect to the post and provided with a plurality of support shafts each having one end fixed to an inner periphery of the cover frame and a support roller rotatably coupled to the other end of each of the support shafts for supporting the rails of the rotary body.

7. The rotary sign board as defined in claim 1, wherein the driving portion comprises a driving motor fixed at the top or bottom side of the cover frame and a decelerator connected at an input shaft to a rotary shaft of the driving motor and at an output shaft to the rotary portion, for increasing and decreasing the rotary force thereof.

8. The rotary sign board as defined in claim 1, wherein the rotary portion is connected to the output shaft of the decelerator for rotating the rotary body with the rotary force applied from the driving portion and comprises a friction wheel for rotating the rail of the rotary body by the friction force thereof and a pressurizing assembly for pressurizing the rotary body against the friction wheel, thus providing a given friction force between the rail and the friction wheel.

9. The rotary sign board as defined in claim 8, wherein the pressurizing assembly is disposed in a radial direction with respect to the post between the cylindrical post and the cover frame and provided with a spring guide bar secured to the inner periphery of the cover frame at the one end thereof and forming a spring support end at the other end thereof, a spring guided by the spring guide bar and supported at the one end thereof by the spring support end, a pressurizing roller frame pressurized against the friction wheel by the other end of the spring, and a pressurizing roller rotatably coupled with the pressurizing roller frame around the shaft parallel to the shaft of the friction wheel and contacted with the rail of the rotary body to pressurize the rail.

10. The rotary sign board as defined in claim 1, wherein the support rod further comprises a length adjustor screwed with the lower end thereof for adjusting the length thereof.

11. A rotary sign board comprising:

a support portion provided with a plurality of circular support members each coupled at the side end thereof with the side end of the adjacent support member to form a round band shape, such that with coupling force thereof, the support portion is secured to the outer periphery of a post, and with a rack having a given width along an upper outer periphery thereof for supporting given load applied over the rack;

a cover frame for surrounding the outer periphery of the post in predetermined thickness and width, fixed supportably to the rack of the support portion, and having a transparent window formed along an outer peripheral surface thereof;

a rotary body disposed in parallel with respect to the outer peripheral surface of the post and disposed between the post and the transparent window of the cover frame, the rotary body provided with a display panel displaying advertising information and formed of a cylindrical resin panel having given rigidity capable of maintaining the shape during the rotation of the rail and with a rail fixedly coupled to each of a top and a bottom of the display panel;

a driving portion fixed to abut against a top side of the cover frame and for providing a rotary force to the rotary body;

a rotary body support portion provided between the post and the cover frame, secured to the cover frame at the one end thereof, and rotatably supporting the rail of the rotary body; and a rotary portion rotatably connected to an output shaft of the driving portion, the rotary portion provided with a friction wheel for rotating the rails of the rotary body by the friction force thereof and with a pressurizing assembly for pressurizing the rotary body against the friction wheel, thus providing a given friction force between the rail and the friction wheel.

* * * * *